US010166170B2

(12) United States Patent
Pinkus et al.

(10) Patent No.: US 10,166,170 B2
(45) Date of Patent: Jan. 1, 2019

(54) ROUND STEAMHEAD FOR A STEAM GENERATOR

(71) Applicant: SUSSMAN AUTOMATIC CORPORATION, Long Island City, NY (US)

(72) Inventors: Michael J. Pinkus, Pleasantville, NY (US); Peter A. Titolo, Kings Park, NY (US); Dave LaPorta, Matawan, NJ (US)

(73) Assignee: Sussman Automatic Corporation, Long Island City, NY (US)

( * ) Notice: Subject to any disclaimer, the term of this patent is extended or adjusted under 35 U.S.C. 154(b) by 33 days.

(21) Appl. No.: 15/448,003

(22) Filed: Mar. 2, 2017

(65) Prior Publication Data

US 2017/0258678 A1 Sep. 14, 2017

Related U.S. Application Data

(60) Provisional application No. 62/305,176, filed on Mar. 8, 2016, provisional application No. 62/332,214, filed on May 5, 2016.

(51) Int. Cl.
*A61H 33/00* (2006.01)
*A61H 33/06* (2006.01)

(52) U.S. Cl.
CPC ..... *A61H 33/6063* (2013.01); *A61H 33/065* (2013.01); *A61H 33/6021* (2013.01); *A61H 2033/068* (2013.01); *A61H 2201/0126* (2013.01); *A61H 2201/5053* (2013.01)

(58) Field of Classification Search
CPC ..... A61H 33/6063; A61H 33/6021; A61H 2033/068; A61H 2201/0126; A61H 2201/5053
USPC ..... 4/524
See application file for complete search history.

(56) References Cited

U.S. PATENT DOCUMENTS 3,557,389 A * 1/1971 Scobey ..... A61H 33/063 392/402
5,435,020 A * 7/1995 Maskell ..... A61H 33/06 4/524
2002/0096575 A1* 7/2002 Altman ..... A61H 33/063 239/11
2013/0097773 A1* 4/2013 Pinkus ..... F21V 21/00 4/524

(Continued)

*Primary Examiner* — Benjamin R Shaw
(74) *Attorney, Agent, or Firm* — Haug Partners LLP; William S. Frommer

(57) ABSTRACT

The steamhead includes a dispensing chamber having an inlet connected to receive steam from a steam generator located outside of the steam bath enclosure and a steam outlet. The steamhead is mounted between studs which support the enclosure wall by a bracket that is adjustable to accommodate studs of different spacing. A hollow cylindrical member extends from the front of the chamber in alignment with the steam outlet. A first part is telescopically received within the hollow member to accommodate enclosure walls of various thicknesses. A flange extends from the rim of the first part to overlap the chamber edge which defines the steam outlet. A second part having a round, concave surface facing the interior of the enclosure is rotatably mounted within the first part for controlling the flow of steam through the steam passageway. The chamber includes baffles for reducing the force of the emitted steam.

27 Claims, 6 Drawing Sheets

(56) References Cited

U.S. PATENT DOCUMENTS

| | | | | |
|---|---|---|---|---|
| 2014/0083467 | A1* | 3/2014 | Dehn | A47L 11/4086 134/37 |
| 2017/0020782 | A1* | 1/2017 | Pinkus | A61H 33/6052 |

* cited by examiner

ROUND STEAMHEAD FOR A STEAM GENERATOR

CROSS-REFERENCE TO RELATED APPLICATIONS

Priority is claimed on Provisional Patent Application Ser. No. 62/305,176, filed Mar. 8, 2016 and on Provisional Patent Application No. 62/332,214, filed May 5, 2016.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to steam generators for residential and commercial steam baths and more particularly to a round steamhead for such a steam generator which features an in-wall expansion chamber and is adjustable to control the direction of the emitted steam and can be easily mounted between vertical steam bath enclosure wall supports of different spacing and can be adjusted for a range of wall thickness.

2. Description of Prior Art Including Information Disclosed Under 37 CFR 1.97 and 1.98

Steamheads for use in residential and commercial steam baths of various shapes and types are known in the art. Steam baths commonly include a steam generator which is located outside the steam bath enclosure. The steam generator provides steam to a steamhead located in the enclosure through a supply pipe. The steamhead is situated at the end of the steam pipe and serves to redirect and disperse the steam as it enters the enclosure.

In a residential steam bath, the enclosure is usually a shower stall. Commercial steam baths typically have a larger enclosure in the form of a steam room which can accommodate multiple occupants. In both cases, the steamhead receives steam from the steam generator through a steam supply pipe. The pipe supplies steam to the steamhead which in turn dispenses the steam into the enclosure interior.

Often the steamhead has a steam outlet in the form of a small port which directs the steam downwardly toward the enclosure floor. In commercial steam rooms the steam exits the steam outlet with force because it is under pressure.

There are multiple benefits if the velocity of the steam can be reduced and direction of the steam can be controlled, including the reduction of risk of injury, and reduction of noise.

Conventional steamheads are located within the steam bath enclosure. The steam travels down the pipe from the steam generator, hits the steamhead where the steam changes direction, and disperses at full velocity inside the steam enclosure with the accompanying noise and turbulence. In the present invention, all this occurs inside a chamber, where it is muffled. The result is that the steam exits the steamhead at a lower velocity with minimal noise.

In order to accomplish this, a sizeable dispensing chamber is required. For aesthetic and safety reasons, the dispensing chamber is designed to be secured behind the enclosure wall in the wall cavity between vertical support members, commonly known as "studs".

However, enclosure walls are typically formed of waterproof cement board to which marble, tile or the like is fixed by thinset. Since the amount of thinset used varies, and the thickness of the marble, title or the like varies, enclosure walls may have different thicknesses. Further, the studs which support the enclosure walls may be spaced apart different distances. It is therefore advantageous to provide a steamhead which can be easily adjusted for use with steam enclosures having walls of different thicknesses and between studs of different spacing.

Aside from the safety issues and installation concerns, it is important that the steamhead have an aesthetically pleasing appearance. The visible portion of the steamhead should complement the decor of the steam bath enclosure and decorative fixtures such as the shower head. The shape of the visible portion of the steamhead should be simple and easy to clean. The steamhead should be unobtrusive and should extend minimally into the enclosure to the point where it is least likely to be contacted by a steam bath occupant, thereby reducing the risk of burns.

It is therefore a prime object of the present invention to provide a steamhead wherein the visible portion is round.

It is another object of the present invention to provide a round steamhead for a steam bath in which the velocity of the emitted flow steam is reduced.

It is another object of the present invention to provide a round steamhead for a steam bath in a trumpet shape and with an internal deflector to cause the steam to exit circumferentially to the steam head and parallel to the wall.

It is another object of the present invention to provide a round steamhead for a steam bath in which the direction of the emitted steam can be adjusted.

It is another object of the present invention to provide a round steamhead for a steam bath in which the noise level of the emitted steam is reduced.

It is another object of the present invention to provide a round steamhead for a steam bath in which a chroma or colored lighting module can be installed.

It is another object of the present invention to provide a round steamhead for a steam bath in which a chroma or colored lighting module is accessible from the steam bath for maintenance purposes.

It is another object of the present invention to provide a round steamhead with an oil reservoir into which aromatic oils can be deposited.

It is another object of the present invention to provide a round steamhead into which aromatic wicks can be inserted into the steam outlet.

It is another object of the present invention to provide a round steamhead for a steam bath which is easy to install.

It is another object of the present invention to provide a round steamhead for a steam bath in which is adjustable to accommodate studs of different spacing.

It is another object of the present invention to provide a round steamhead for a steam bath which can accommodate enclosure walls of different thicknesses.

It is another object of the present invention to provide a round steamhead for a steam bath which is aesthetically pleasing.

It is another object of the present invention to provide a round steamhead for a steam bath which is simple in design, mechanically sound and has a log useful life.

BRIEF SUMMARY OF THE INVENTION

The above objects are achieved by the steamhead of the present invention which is designed for use in a steam bath enclosure including a wall with an opening. The steamhead is used with a steam generator having a steam supply pipe. The steamhead includes a dispensing chamber with an inlet connected to the steam supply pipe and a steam outlet. A hollow cylindrical member extends from the dispensing chamber in alignment with the steam outlet of the chamber. A first part defines a steam passageway from the dispensing chamber to the interior of the steam bath enclosure. The first part is mounted within the hollow member for movement between a position proximate the dispensing chamber and a position remote from the dispensing chamber to accommodate enclosure walls of different thicknesses. A second part is rotatably mounted within the first part for controlling the steam exiting the steam passageway.

The first part has a support structure including a central hub defining a generally cylindrical recess. The second part includes a rearwardly extending portion adapted to be received within the support structure recess.

The second part has a substantially round surface facing the steam bath enclosure. Preferably, the surface has a concave contour.

The second part includes a radially extending member adapted to block a portion of the steam passageway to control the direction of the steam emitted by the steamhead. The portion of the steam passageway that is blocked by the radial member is determined by the rotational position of the first part relative to the second part.

The first part has an exterior rim. A flange extends from the rim of the first part. The flange overlaps the edge of the enclosure wall which defines the steam opening.

The first part is adapted to be telescopically received within the hollow member.

The enclosure wall opening through which the steamhead extends is situated between spaced vertical members which support the enclosure wall. Means are provided for attaching the dispensing chamber between the support members, with the steam outlet aligned with the enclosure wall opening. The attaching means is an adjustable bracket which can accommodate supports which are spaced apart by different distances.

The steamhead further includes at least one baffle within the dispensing chamber. The baffle serves to reduce the force of the emitted steam.

In accordance with another aspect of the present invention, a steamhead is provided for use with a steam bath having an enclosure including a wall with an opening. The steamhead is designed for use with a steam generator having a steam supply pipe. The steamhead includes a dispensing chamber with an inlet connected to the steam supply pipe and a round steam outlet. A hollow cylindrical member extends from the dispensing chamber in alignment with the steam outlet and defines a steam passageway. A first part is telescopically received within the hollow member for movement between a position proximate the dispensing chamber and a position remote from the dispensing chamber. The first part has a flange. A second part is mounted within the first part and has a round surface facing the enclosure.

The first part includes a support structure with a central hub defining a generally cylindrical recess. The second part has a rearwardly extending portion adapted to be rotatably received within the first part recess.

The second part includes a radially extending member which blocks a portion of the steam passageway. The portion of the steam passageway blocked by the radial member is determined by the rotational position of the first part relative to the second part. Thus, the second part is rotatable to control the direction of the steam exiting the steam passageway.

The enclosure wall opening is defined by an edge. The flange overlaps the wall edge.

The enclosure wall opening is situated between spaced support members. Means are provided for attaching the steamhead between the support members of the enclosure wall, with the steam outlet aligned with the enclosure wall opening. The attaching means is adjustable to accommodate wall support members which are spaced apart by different distances.

At least one baffle is situated within the dispensing chamber.

Further, a tray is provided for retaining aromatic substances such as oil, tablets or sheets.

BRIEF DESCRIPTION OF THE SEVERAL VIEWS OF DRAWINGS

To these and to such other objects that may hereinafter appears, the present invention relates to a round steamhead for a steam bath as described in detail in the following specification and recited in the annexed claims, taken together with the accompanying drawings, in which like numerals refer to like parts and in which:

DETAILED DESCRIPTION OF THE INVENTION

Figure 1:
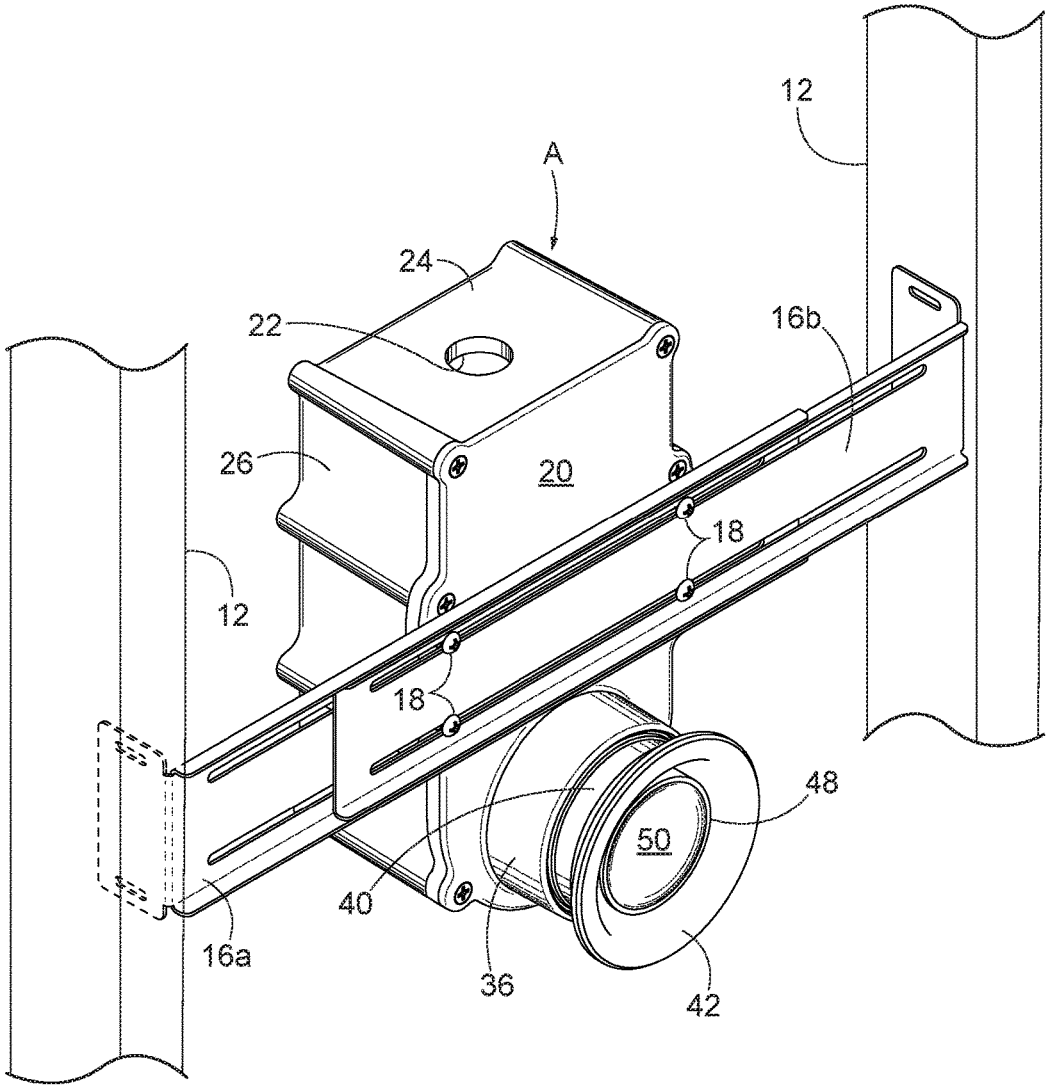
FIG. 1 is a perspective view of the steamhead of the present invention showing the front, left side and top thereof.
Figure 2:
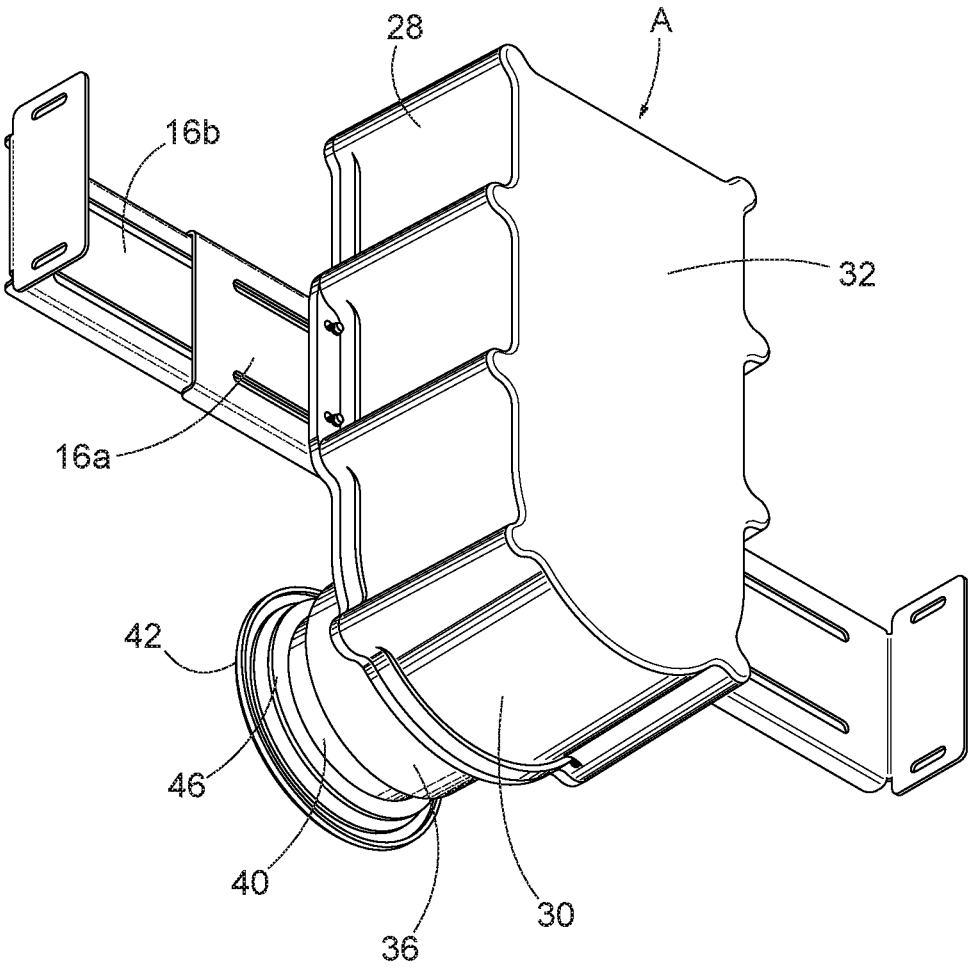
FIG. 2 is a perspective view of the steamhead of the present invention showing the rear, right side and bottom thereof.
Figure 3:
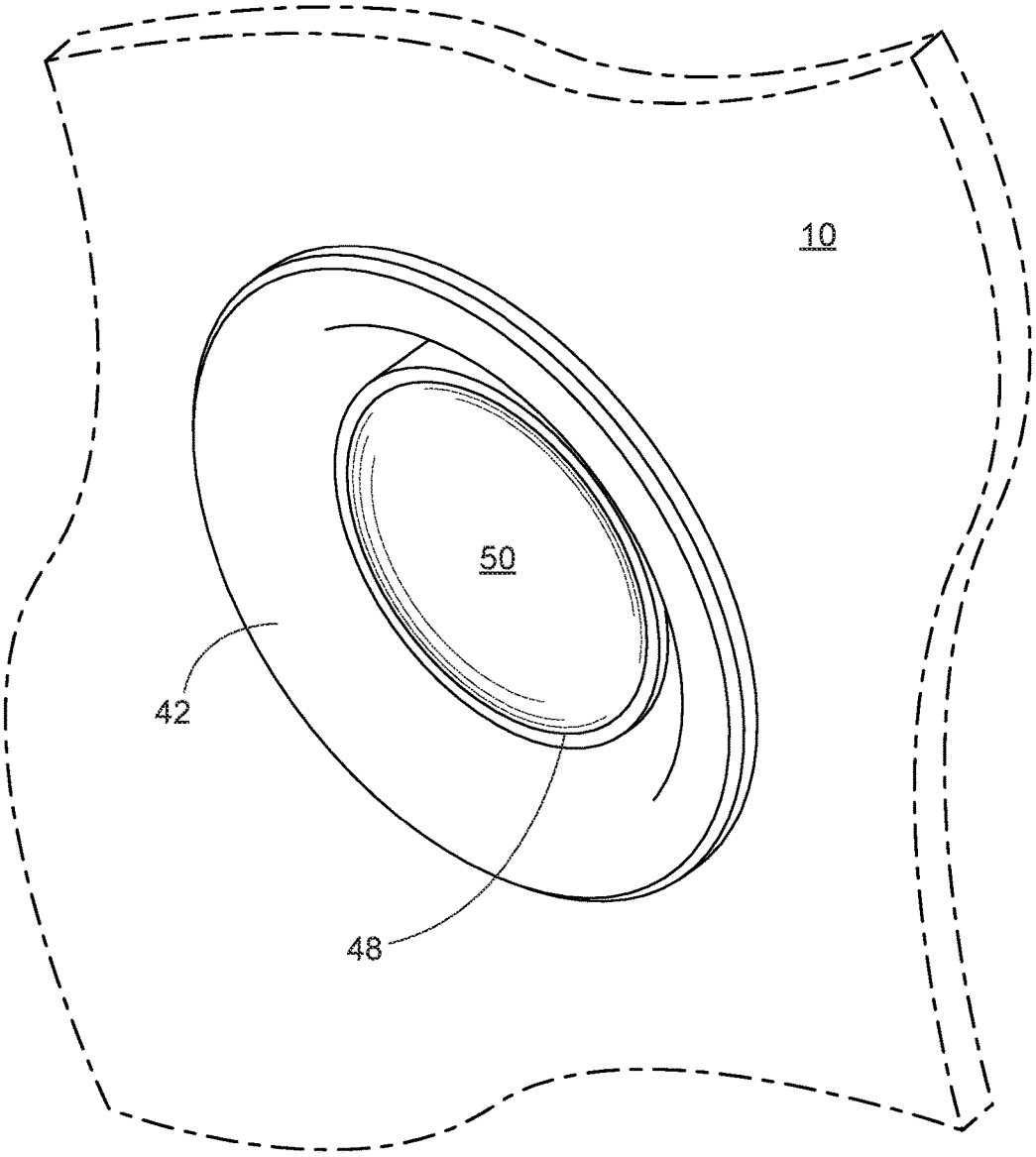
FIG. 3 is a perspective view of the steamhead of the present invention as it would appear mounted to a steam bath enclosure wall.

The steamhead of the present invention is designed for use with a steam bath enclosure including an enclosure wall 10. Enclosure wall 10 is supported by spaced vertical support members or studs 12. The steamhead is mounted behind the wall, between the studs, in alignment with an opening 14 in the wall. The steamhead is suspended between adjacent studs by an adjustable bracket 16.

Bracket 16 includes first and second sections 16*a*, 16*b*. The bracket sections can be moved relative to each other to alter the length of the bracket so that the bracket can accommodate a wide range of stud spacing. For this purpose, the bracket sections each have vertically spaced, horizontally elongated slots. When the brackets are aligned, the slots line up.

Screws 18 are provided to secure the bracket to the front surface 20 of the steam dispensing chamber of the steamhead, generally designated A. Once the bracket sections are in the correct relative position according to the stud spacing, the screws are tightened to secure the brackets to the chamber with the bracket sections in the desired relative position.

At the end of each bracket section is bent portion with elongated openings. The openings in the bent end portions accept screws for fastening each of the bracket sections to the adjacent stud. The elongated openings in the end portions allow the bracket to be attached to the studs at the appropriate depth.

The steamhead is designed for use with a steam generator (not shown) situated at a remote location outside the steam bath enclosure. The steam generator has a steam outlet connected to a supply pipe which conveys steam from the steam generator to dispensing chamber A through a steam inlet 22 in the top surface 24 of chamber A.

Figure 4:
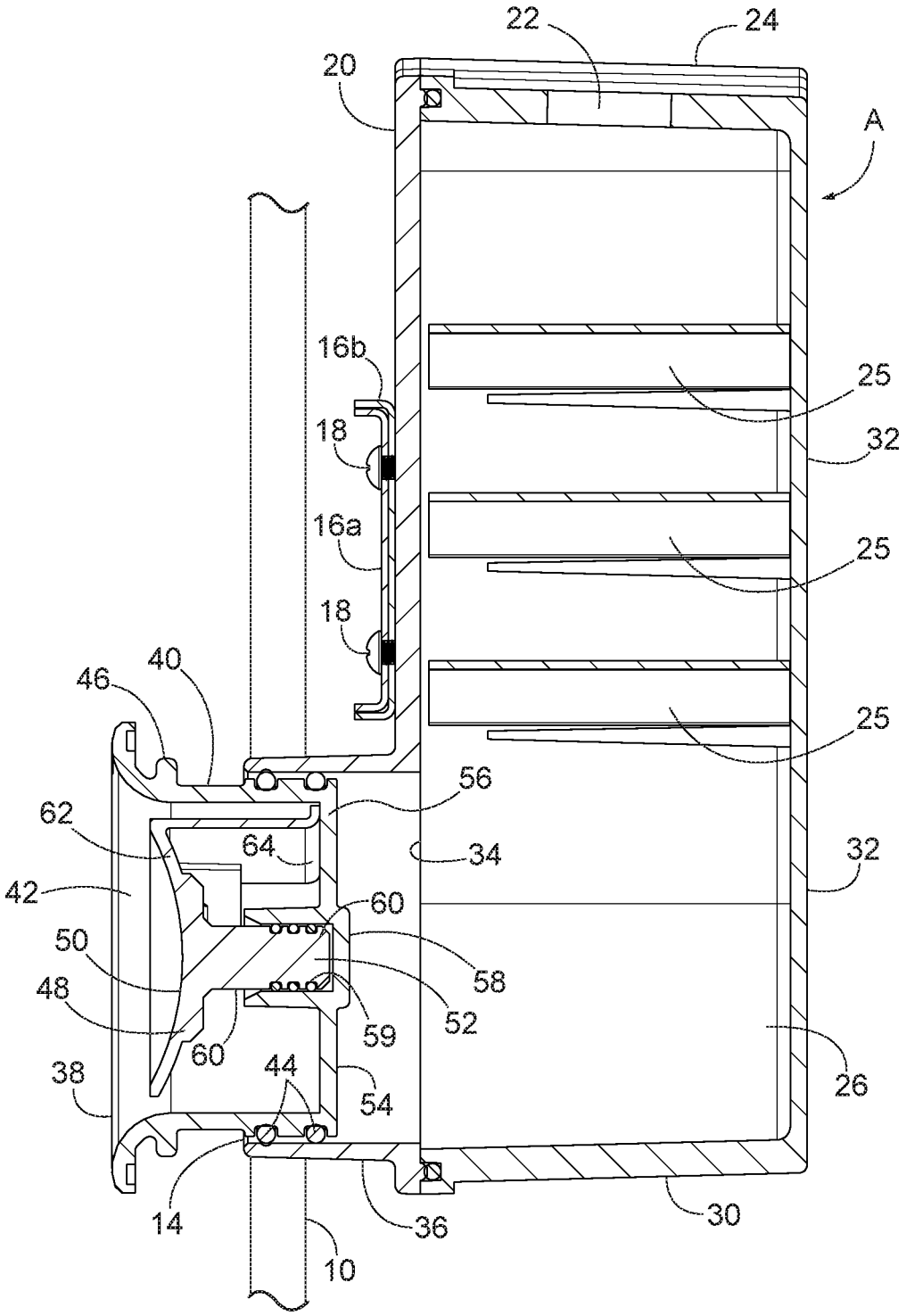
FIG. 4 is a cross-sectional elevational view of the steamhead of the present invention showing the interior parts thereof.
Figure 5:
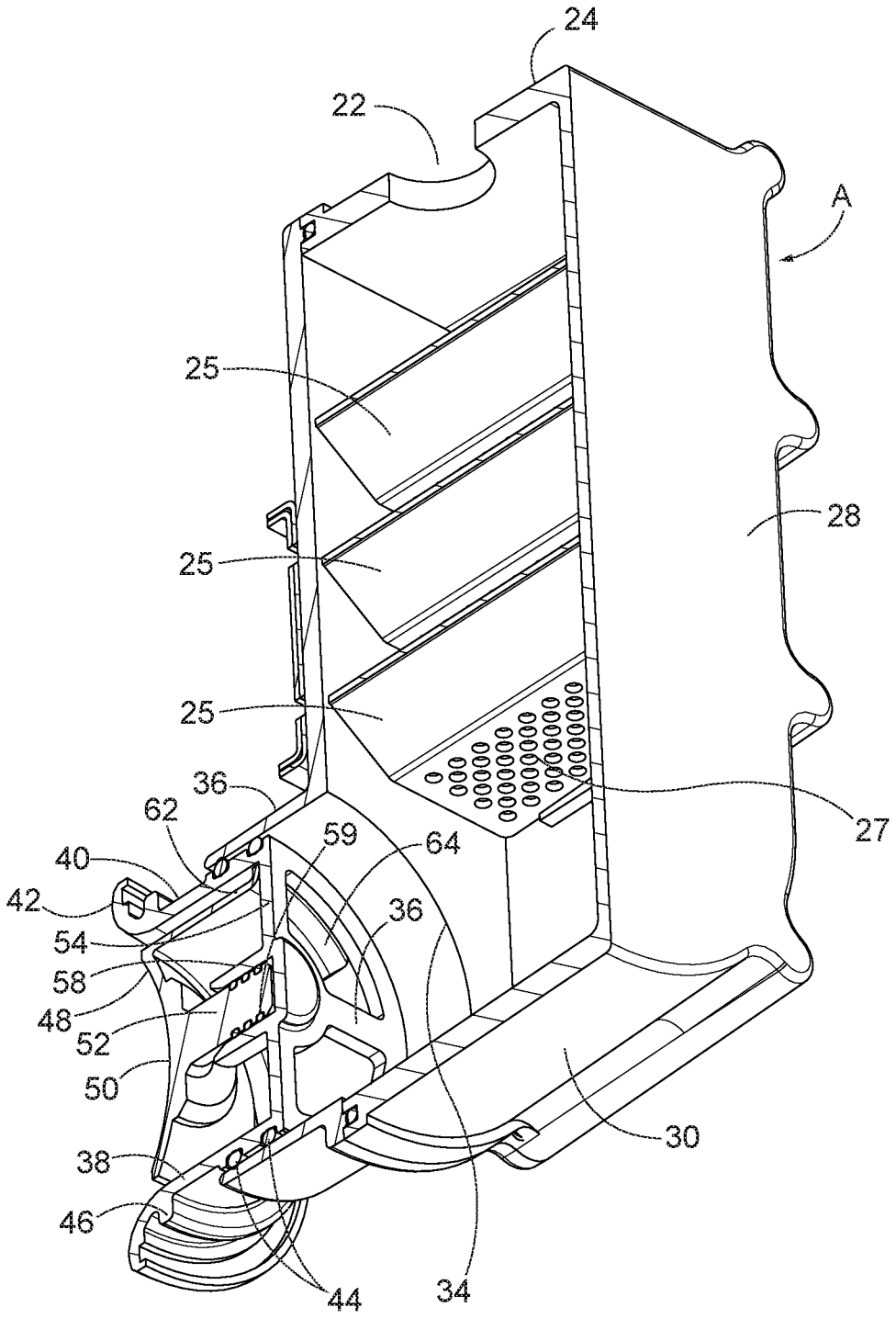
FIG. 5 is a cross-sectional perspective view of the steamhead of the present invention.
Figure 6:
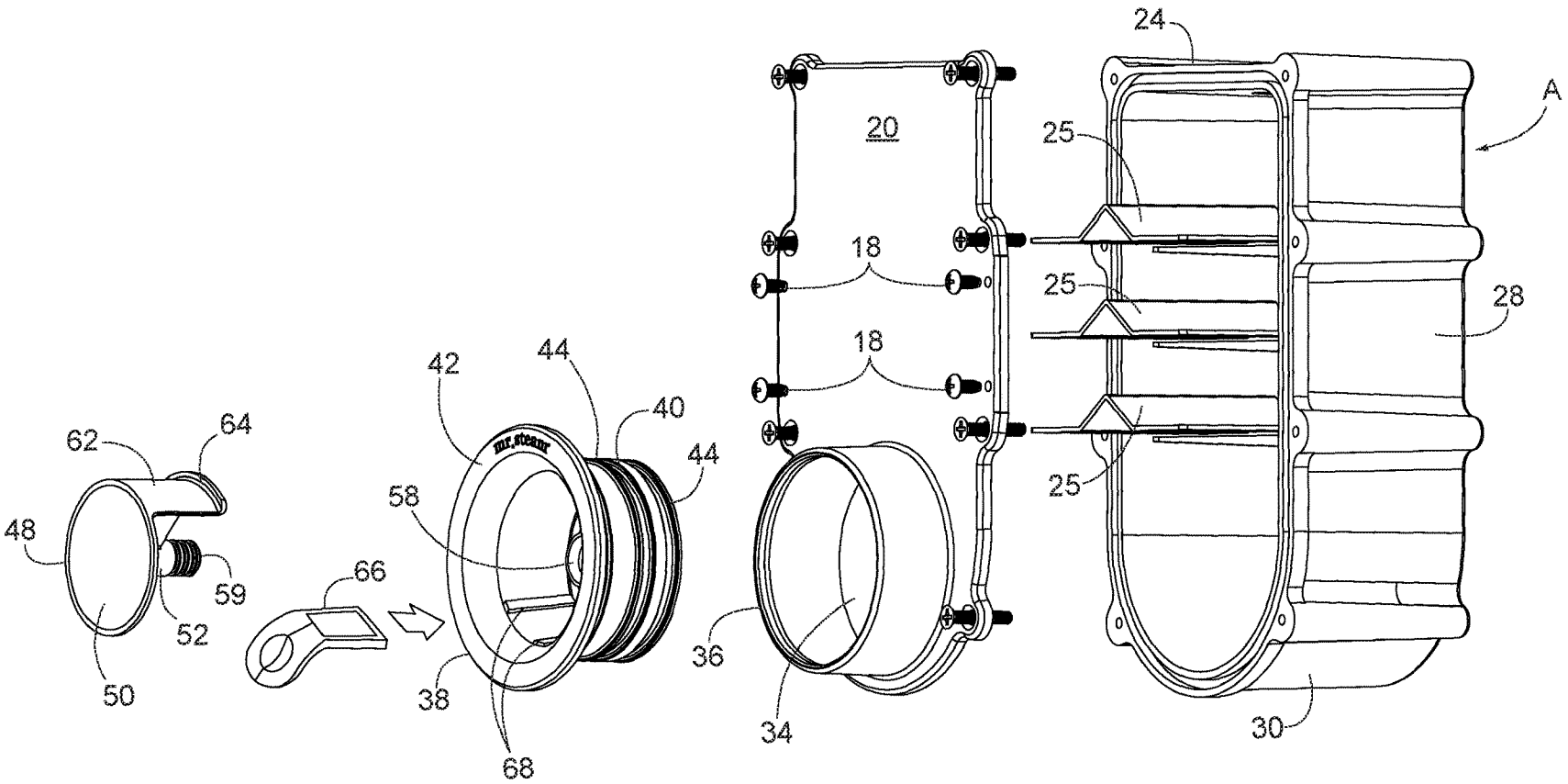
FIG. 6 is an exploded perspective view of the parts of the present invention.

As seen in FIGS. 4, 5 and 6, the interior of chamber A has a series of vertically spaced, pitched baffles 25. The baffles each have a series of openings 27 as seen in FIG. 5. In conventional steam systems the steam travels down the pipe from the generator and hits the steam head. The steam then changes direction and disperses at full velocity inside the steam room (with the accompanying noise and turbulence). With the steamhead of the present invention, all this occurs inside chamber A, where it is muffled. Thus, the steam exits at a lower velocity with minimal noise.

Chamber A also has a left side 26, a right side 28, a bottom surface 30 and a rear surface 32. The front surface 20 of the chamber has a round steam outlet 34. A hollow cylindrical member 36 is fixed to and extends from the front surface 20 of chamber A in alignment with the steam outlet.

A first part 38 is received within member 36. Part 38 is telescopically received within hollow member 36. Part 38 can be moved relative to member 36 between a position proximate front surface 20 of chamber A and a position remote from front surface 20 of chamber A.

Part 38 has a hollow cylindrical portion 40 with exterior rim. The rim of part 38 is curved outwardly to form a flange 42. Once the steamhead is mounted behind the enclosure wall, part 38 can be moved inwardly relative to hollow member 36 such that flange 42 is located adjacent to and covers the edge of the enclosure wall which defines opening 14.

The exterior wall of portion 40 of part 38 is sealed to the interior wall of hollow member 36 by spaced rubber O-rings 44. A circumferential stop ring 46 extends outwardly from portion 40 of part 38 at a location behind flange 42. Stop ring 46 limits the inward movement of part 38 within hollow member 36.

Mounted within part 38 is a second part 48. Part 48 is round and preferably has a concave exterior surface 50. Surface 50 is attached to a rearwardly extending cylindrical part 52.

A wheel-like support structure 54 forms the rear portion of first part 38. Structure 54 includes spokes 56 extending from a central hub 58. Hub 58 defines a recess 60 within which part 52 is rotatably received. O-rings 59 on part 52 are provided to insure a tight fit between the parts.

As best seen in FIG. 6, part 38 has a rearwardly extending side part 62 which carries a radially extending blocking member 64. Part 62 is arcuate such that it follows the curve of the edge of surface 50. Blocking member 64 serves to block a portion of the steam passageway defined by member 36 to control and direct the steam as it exits the steamhead. Rotating part 48 relative to part 38 causes blocking member 64 to move within part 38 and thus to direct the steam flow as desired.

A tray 66 may be slideably received between tracks 68 on the interior surface of part 38. The tray is adapted to retain an aromatic substance such as oil, a tablet, or sheet such that as the steam exits the steamhead it carries with it the aroma which disburses in the steam bath enclosure. The tray may have a cover with one or more openings. Further, the tray may be furnished with the steamhead or as a purchased accessory. The tray may be easily removed from the steamhead for refilling, cleaning or other maintenance.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

We claims:

1. A steamhead for a steam bath enclosure including a wall with an opening, the steamhead designed for use with a steam generator having a steam supply pipe, the steamhead comprising a dispensing chamber with an inlet connected to the steam supply pipe and a steam outlet, a hollow cylindrical member extending from said chamber in alignment with said steam outlet and forming a steam passageway, a first part mounted within said hollow cylindrical member for movement between a position proximate said chamber and a position remote from said chamber, and a second part rotatably mounted within said first part for controlling the flow of steam through said steam passageway.

2. The steamhead of claim 1 wherein said first part comprises a support structure including a recess and wherein said second part comprises an extending portion adapted to be received within said recess.

3. The steamhead of claim 1 wherein said second part has a substantially round surface facing the steam bath enclosure.

4. The steamhead of claim 1 wherein said second part comprises a radially extending member adapted to block a portion of said steam passageway.

5. The steamhead of claim 4 wherein the portion of said steam passageway blocked by said member is determined by the rotational position of said first part relative to said second part.

6. The steamhead of claim 1 wherein said first part comprises an exterior rim and further comprises a flange extending from said rim.

7. The steamhead of claim 6 wherein the enclosure wall opening is defined by an edge and wherein said flange overlaps the enclosure wall edge.

8. The steamhead of claim 1 wherein said first part is adapted to be telescopically received within said hollow cylindrical member.

9. The steamhead of claim 1 wherein said second part is rotatable relative to the second part to control the direction of the steam exiting said steam passageway.

10. The steamhead of claim 1 wherein the enclosure wall opening is situated between spaced support members and further comprising means for attaching said steamhead between the support members of the enclosure wall, with said steam outlet aligned with the enclosure wall opening.

11. The steamhead of claim 10 further comprising means for attaching said steamhead between the enclosure wall supports.

12. The steamhead of claim 11 wherein said attaching means is adjustable to accommodate supports of different spacing.

13. The steamhead of claim 1 further comprising at least one baffle within said dispensing chamber.

14. The steamhead of claim 1 further comprising a tray for retaining aromatic substances.

15. The steamhead of claim 14 further comprising tracks on the surface of said second part for mounting said tray.

16. A steamhead for a steam bath enclosure including a wall with an opening, the steamhead designed for use with a steam generator having a steam supply pipe, the steamhead comprising a dispensing chamber with an inlet connected to the steam supply pipe and a round steam outlet, a hollow cylindrical member extending from said chamber in alignment with said steam outlet and defining a steam passageway, a first part telescopically mounted within said hollow cylindrical member for movement between a position proximate said chamber and a position remote from said chamber, said first part comprising a flange, and a second part mounted within said first part and having a round surface facing the enclosure.

17. The steamhead of claim 16 wherein said first part comprises a support structure including a hub with a recess and wherein said second part comprises an extending portion adapted to be received within said recess.

18. The steamhead of claim 16 wherein said second part comprises a radially extending member adapted to block a portion of said steam passageway.

19. The steamhead of claim 18 wherein the portion of said steam passageway blocked by said radially extending member is determined by the rotational position of said first part relative to said second part.

20. The steamhead of claim 16 wherein the enclosure wall opening is defined by an edge and wherein said flange overlaps the wall edge.

21. The steamhead of claim 16 wherein said second part is rotatable relative to said first part to control the direction of the steam exiting said steam passageway.

22. The steamhead of claim 16 wherein the enclosure wall opening is situated between spaced support members and further comprising means for attaching said steamhead between the support members of the enclosure wall, with said steam outlet aligned with the enclosure wall opening.

23. The steamhead of claim 22 further comprising means for attaching said steamhead between the enclosure wall supports.

24. The steamhead of claim 23 wherein said attaching means is adjustable to accommodate supports of different spacing.

25. The steamhead of claim 16 further comprising at least one baffle within said dispensing chamber.

26. The steamhead of claim 16 further comprising a tray for retaining aromatic substances.

27. The steamhead of claim 26 further comprising tracks on the surface of said second part for mounting said tray.

* * * * *